US012612761B2

(12) United States Patent
La Fontaine

(10) Patent No.: US 12,612,761 B2
(45) Date of Patent: Apr. 28, 2026

(54) ROCKBREAKER MANIPULATION APPARATUS

(71) Applicant: Joshua La Fontaine, Bedfordale (AU)

(72) Inventor: Joshua La Fontaine, Bedfordale (AU)

( * ) Notice: Subject to any disclaimer, the term of this patent is extended or adjusted under 35 U.S.C. 154(b) by 760 days.

(21) Appl. No.: 17/995,471

(22) PCT Filed: Apr. 7, 2021

(86) PCT No.: PCT/AU2021/050320

§ 371 (c)(1),
(2) Date: Oct. 4, 2022

(87) PCT Pub. No.: WO2021/203167

PCT Pub. Date: Oct. 14, 2021

(65) Prior Publication Data

US 2023/0145412 A1 May 11, 2023

(30) Foreign Application Priority Data

Apr. 7, 2020 (AU) ..... 2020901087

(51) Int. Cl.
*E02F 3/96* (2006.01)

(52) U.S. Cl.
CPC ..... *E02F 3/961* (2013.01); *E02F 3/962* (2013.01); *E02F 3/966* (2013.01)

(58) Field of Classification Search
CPC . E02F 3/961; E02F 3/962; E02F 3/963; E02F 3/964; E02F 3/965; E02F 3/966
USPC ..... 172/438, 518, 527; 37/403, 404, 405, 37/406, 407, 408, 409, 410
See application file for complete search history.

(56) References Cited

U.S. PATENT DOCUMENTS 4,466,494 A * 8/1984 Hanson ..... B66C 1/427 241/275
4,602,821 A * 7/1986 Schaeff ..... E02F 3/966 37/403
6,517,164 B1 * 2/2003 White ..... E02F 5/326 37/447

(Continued)

FOREIGN PATENT DOCUMENTS

CN 102261085 A 11/2011
FR 2194849 A1 3/1974
JP 8177075 A 7/1996

OTHER PUBLICATIONS

International Search Report for International Application No. PCT/AU2021/050320, mailed May 17, 2021, 6 pages.

(Continued)

*Primary Examiner* — Matthew Troutman
*Assistant Examiner* — Evan A Bregel
(74) *Attorney, Agent, or Firm* — Cherskov Flaynik & Gurda, LLC

(57) ABSTRACT

Provided is a manipulation apparatus for a rockbreaker, the apparatus comprising a manipulation tool defining at least one substantially flat surface, a mounting configured to swivelably mount the manipulation tool on the rockbreaker such that an angle formed between an axis along the flat surface and an impact axis of the rockbreaker is infinitely adjustable. Apparatus further includes an actuator arrangement configured to swivel the tool so that the flat surface is selectively and infinitely adjustable relative to the impact axis to facilitate manipulation of material by the tool.

16 Claims, 10 Drawing Sheets

(56) References Cited

U.S. PATENT DOCUMENTS

| | | | | |
|---|---|---|---|---|
| 7,257,910 | B2 | 8/2007 | Underwood | |
| 7,523,997 | B2 | 4/2009 | Jalabert et al. | |
| 9,127,442 | B1 | 9/2015 | Underwood | |
| 2004/0244234 | A1 | 12/2004 | Underwood | |
| 2009/0290940 | A1* | 11/2009 | Martin, Sr. | E02D 3/123 172/136 |

OTHER PUBLICATIONS

International Written Opinion for International Application No. PCT/AU2021/050320, mailed May 17, 2021, 3 pages.

* cited by examiner

ROCKBREAKER MANIPULATION APPARATUS

CROSS-REFERENCE TO RELATED APPLICATIONS

This application is a national phase entry under 35 U.S.C. § 371 of International Patent Application PCT/AU2021/050320, filed Apr. 7, 2021, designating the United States of America and published as International Patent Publication WO 2021/203167 A1 on Oct. 14, 2021, which claims the benefit under Article 8 of the Patent Cooperation Treaty to Australian Patent Application Serial No. 2020901087, filed Apr. 7, 2020.

TECHNICAL FIELD

This disclosure relates to rock breaking, in general, and, more specifically, to manipulation apparatus for a rockbreaker, a rockbreaker having such manipulation apparatus and an associated method of rock breaking.

BACKGROUND

The following discussion of the background art is intended to facilitate an understanding of the disclosure only. The discussion is not an acknowledgement or admission that any of the material referred to is or was part of the common general knowledge as at the priority date of the application.

A rockbreaker is a machine designed to manipulate large rocks, including reducing large rocks into smaller rocks. They are typically used in the mining industry to remove oversize rocks that are too large or too hard to be reduced in size by a crusher. Rockbreakers generally consist of two major components, a hydraulic hammer or drill (used to break rocks) and a boom (the arm). There are two major types of rockbreakers: mobile and stationary. Stationary rockbreakers are typically placed on a pedestal or slew frame, whereas mobile rockbreakers are often mounted on excavator platforms.

The addition of a scoop, edge or blade to a rockbreaker for moving broken material is beneficial to reducing the cost of breaking rock and improving efficiency. Traditionally, rock breaking done with a breaker mounted on an excavator platform requires the operator to break rock or concrete and will frequently get to a point at which they must change attachment to a bucket to remove broken rock from a work area. This process takes a significant amount of time as does the so-called combing technique which is simply using the tool to comb through the broken rock to find hard rock to be broken.

For this reason, a number of attachments to rockbreakers have been proposed in the past. For example, U.S. Pat. No. 9,127,442 describes a rockbreaker attachment for a conventional excavator bucket, which also forms a pincer-like gripper assembly. U.S. Pat. No. 7,523,997 discloses a bucket attachment that fits over a rockbreaker, but does not address the problem of requiring rock breaking work to halt in order to attach or remove the bucket. U.S. Pat. No. 4,602,821 addresses this shortcoming by adding a fold-down or slide-down bucket to a rockbreaker.

In these prior art systems, the proposed attachments are all cumbersome and do not allow precise control during rock breaking work. The prior art systems only allow either rock breaking or use of the attached tool-they do not cater for precise control during rock breaking work, nor allow precise clearance or manipulation of material, often obscuring a rockbreaker operator's line-of-sight of the rockbreaker tool and/or material. Applicant has identified the real nature of the problem with such rockbreaker attachments as not only providing some measure of material manipulation to conventional rockbreakers, but more precise manipulation of material, as well as control during use of the rockbreaker.

The disclosure was conceived with these shortcomings in mind.

BRIEF SUMMARY

The skilled addressee is to appreciate that reference herein to a rockbreaker generally refers to an electromechanical, pneumatic or hydraulic percussion tool having a tool point, chisel or bit operatively and repeatedly struck with a hammer along an impact axis, being the direction of travel of the hammer to the bit along which a resulting percussive force is applicable.

According to a first aspect of the disclosure, there is provided manipulation apparatus for a rockbreaker, the apparatus comprising:

- a manipulation tool defining at least one substantially flat surface;
- a mounting configured to swivelably mount the manipulation tool on the rockbreaker such that an angle formed between an axis along the flat surface and an impact axis of the rockbreaker is infinitely adjustable; and
- an actuator arrangement configured to swivel the tool so that the flat surface is selectively and infinitely adjustable relative to the impact axis to facilitate manipulation of material by the tool.

Typically, the manipulation tool comprises a flat blade-like body.

In an embodiment, the flat blade-like body defines a triangular shape.

Typically, the at least one substantially flat surface of the tool comprises a ground engaging surface on a side of the body.

In an embodiment, the ground engaging surface includes a replaceable cutting edge.

Typically, the mounting comprises a swivel pin about which the flat surface is able to orbit.

Typically, the flat surface of the tool is orbitable about the mounting so that the respective axes are arrangeable in parallel or transverse.

In an embodiment, the mounting mounts the tool on an inside face of the rockbreaker to facilitate visibility of the tool by an operator.

In an embodiment, the actuator arrangement comprises a hydraulic ram with a linkage to the tool such that translation of the ram is converted into rotation of the tool about the mounting.

In another embodiment, the actuator arrangement comprises an electric or hydraulic motor with gearing and/or linkage to swivel the tool on the mount.

In an embodiment, the actuator arrangement comprises a helical hydraulic rotary actuator.

According to a second aspect of the disclosure, there is provided a rockbreaker having manipulation apparatus comprising:

- a manipulation tool defining at least one substantially flat surface;
- a mounting swivelably mounting the manipulation tool on the rockbreaker such that an angle formed between an axis along the flat surface and an impact axis of the rockbreaker is infinitely adjustable; and an actuator arrangement configured to swivel the tool so that the flat surface is selectively and infinitely adjustable relative to the impact axis to facilitate manipulation of material by the tool.

Typically, the manipulation tool comprises a flat blade-like body.

In an embodiment, the flat blade-like body defines a triangular shape.

Typically, the at least one substantially flat surface of the tool comprises a ground engaging surface on a side of the body.

In an embodiment, the ground engaging surface includes a replaceable cutting edge.

Typically, the mounting comprises a swivel pin about which the flat surface is able to orbit.

Typically, the flat surface of the tool is orbitable about the mounting so that the respective axes are arrangeable in parallel or transverse.

In an embodiment, the mounting mounts the tool on an inside face of the rockbreaker to facilitate visibility of the tool by an operator.

In an embodiment, the actuator arrangement comprises a hydraulic ram with a linkage to the tool such that translation of the ram is converted into rotation of the tool about the mounting.

In another embodiment, the actuator arrangement comprises an electric or hydraulic motor with gearing and/or linkage to swivel the tool on the mount.

In an embodiment, the actuator arrangement comprises a helical hydraulic rotary actuator.

According to a third aspect of the disclosure, there is provided a method of rock breaking, the method comprising the steps of:

providing a rockbreaker having manipulation apparatus in accordance with the first aspect of the disclosure;

breaking material, such as rocks, with the rockbreaker; and adjusting, via the actuator arrangement, as desired, the tool relative to the rockbreaker to facilitate manipulation of material.

Typically, the step of adjusting the tool is performed remotely from an operating cabin of the rockbreaker.

BRIEF DESCRIPTION OF THE DRAWINGS

The description will be made with reference to the accompanying drawings in which.

DETAILED DESCRIPTION

Figure 1:
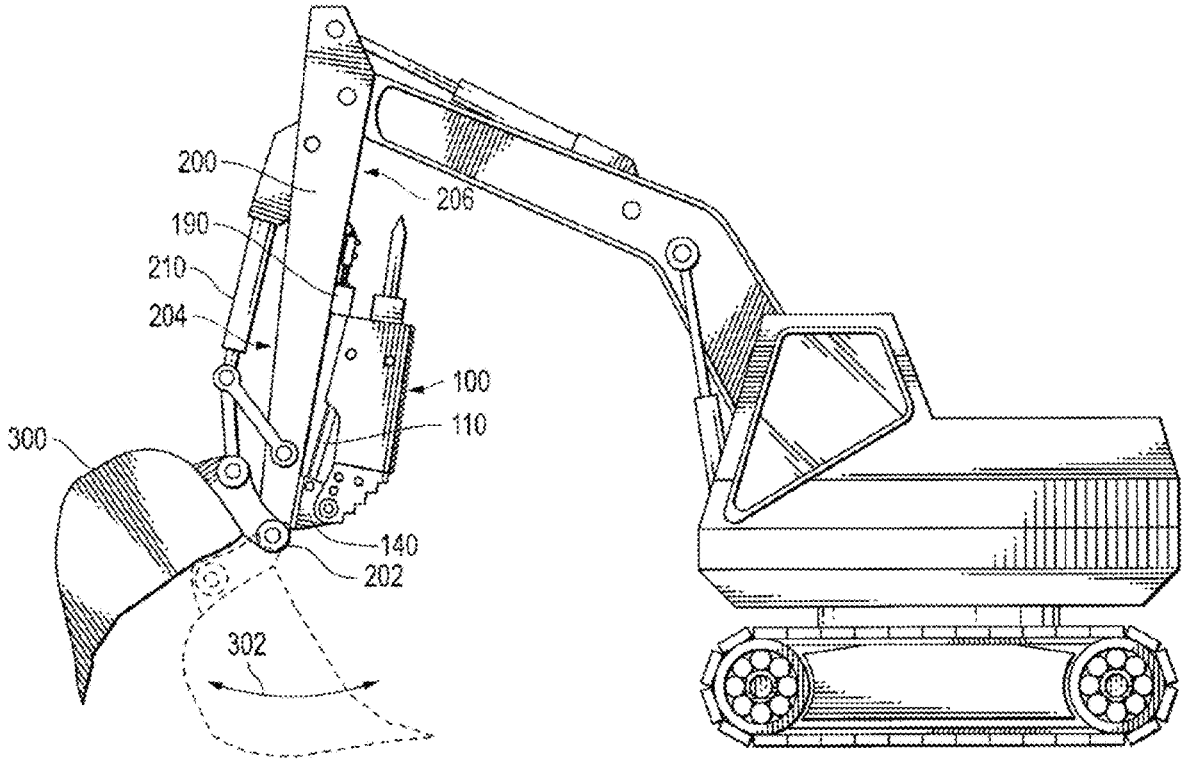
FIG. 1 (PRIOR ART)
FIG. 1 is a prior art representation of a conventional excavator platform having a rockbreaker attachment.
Figure 2:
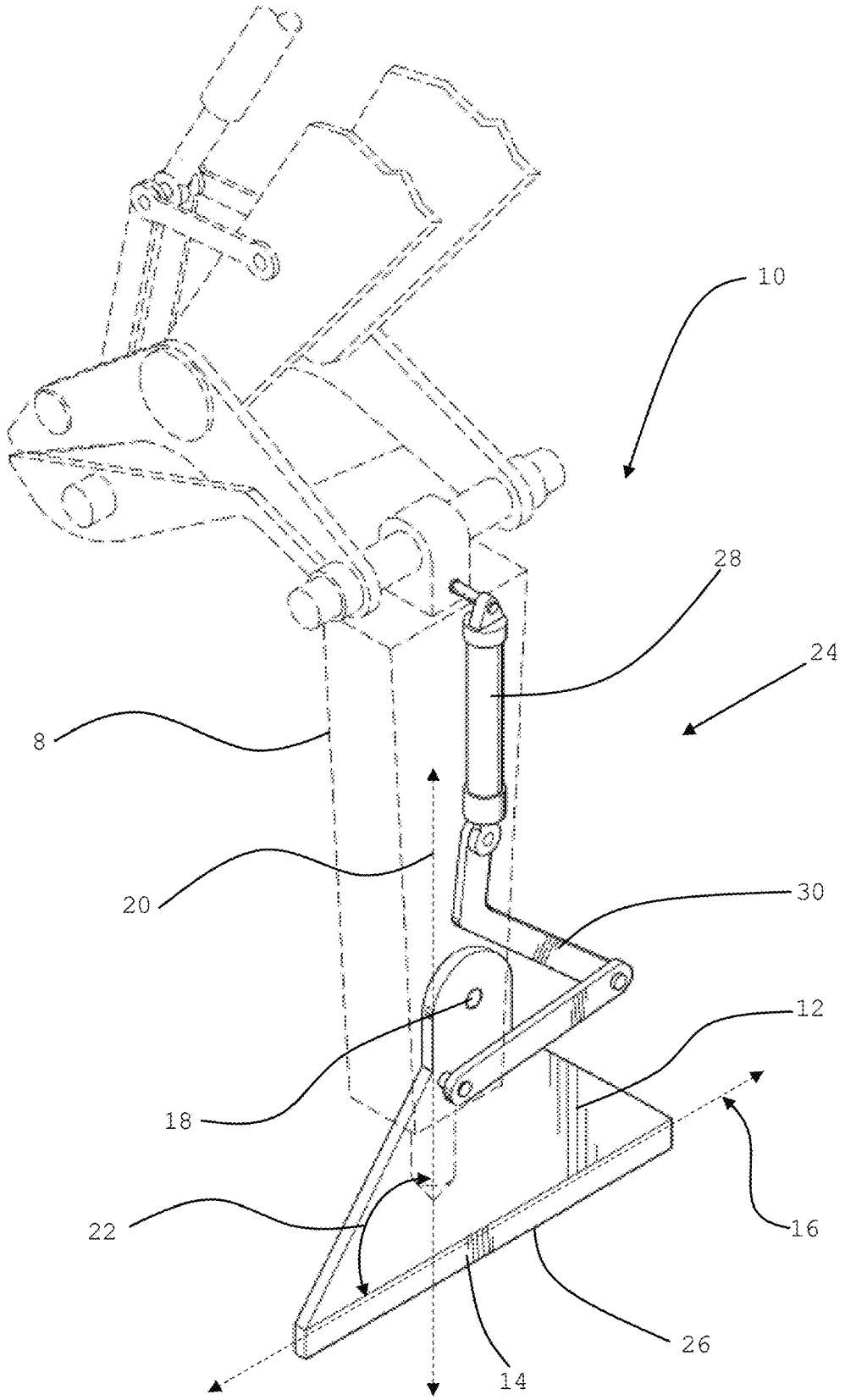
FIG. 2 is a diagrammatic perspective-view representation of one embodiment of manipulation apparatus for a rockbreaker, in accordance with an aspect of the disclosure.
Figure 3:
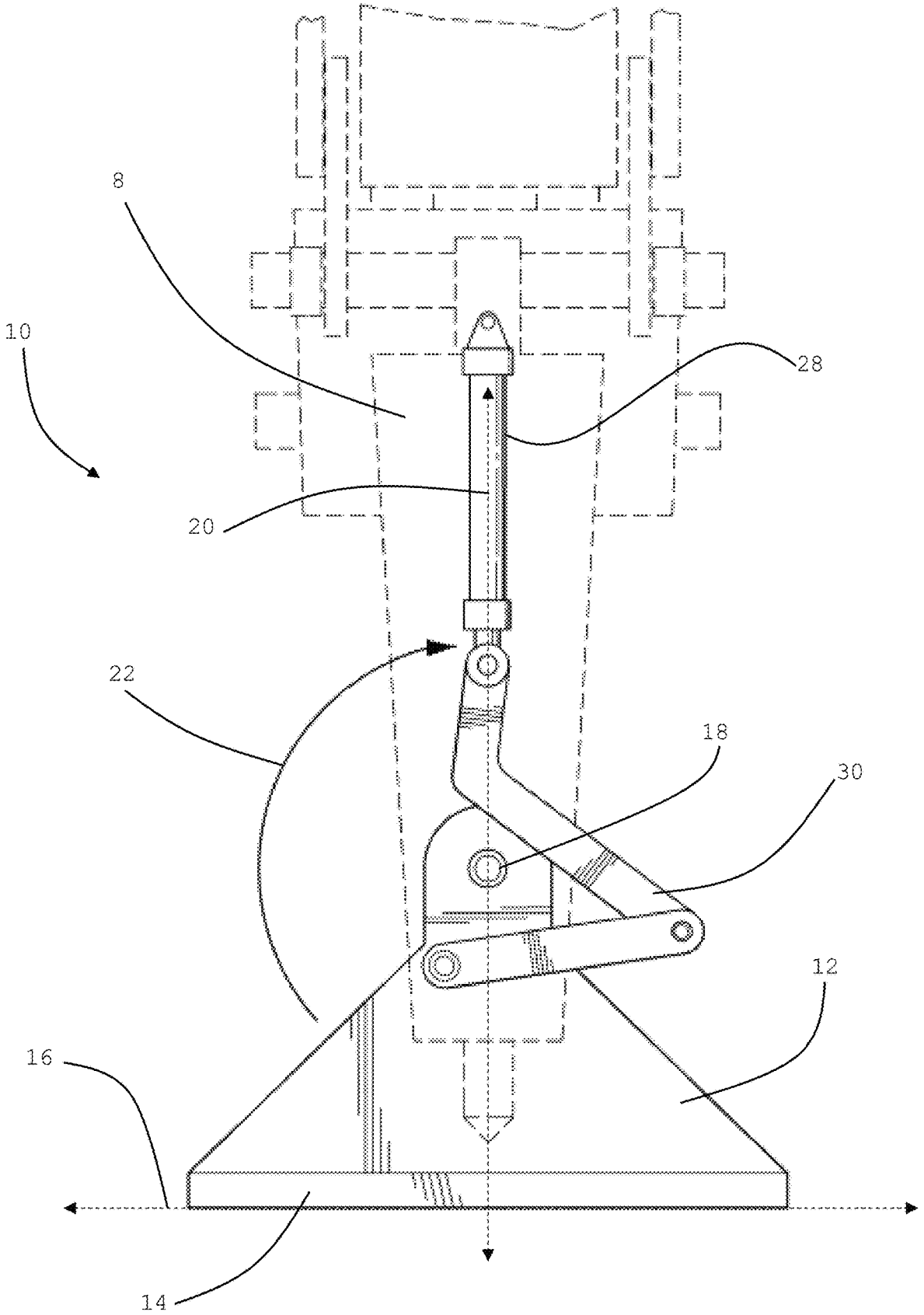
FIG. 3 is diagrammatic front-view representation of the apparatus of FIG. 2 with an angle formed between an axis along the flat surface and an impact axis of the rockbreaker substantially perpendicular.
Figure 4:
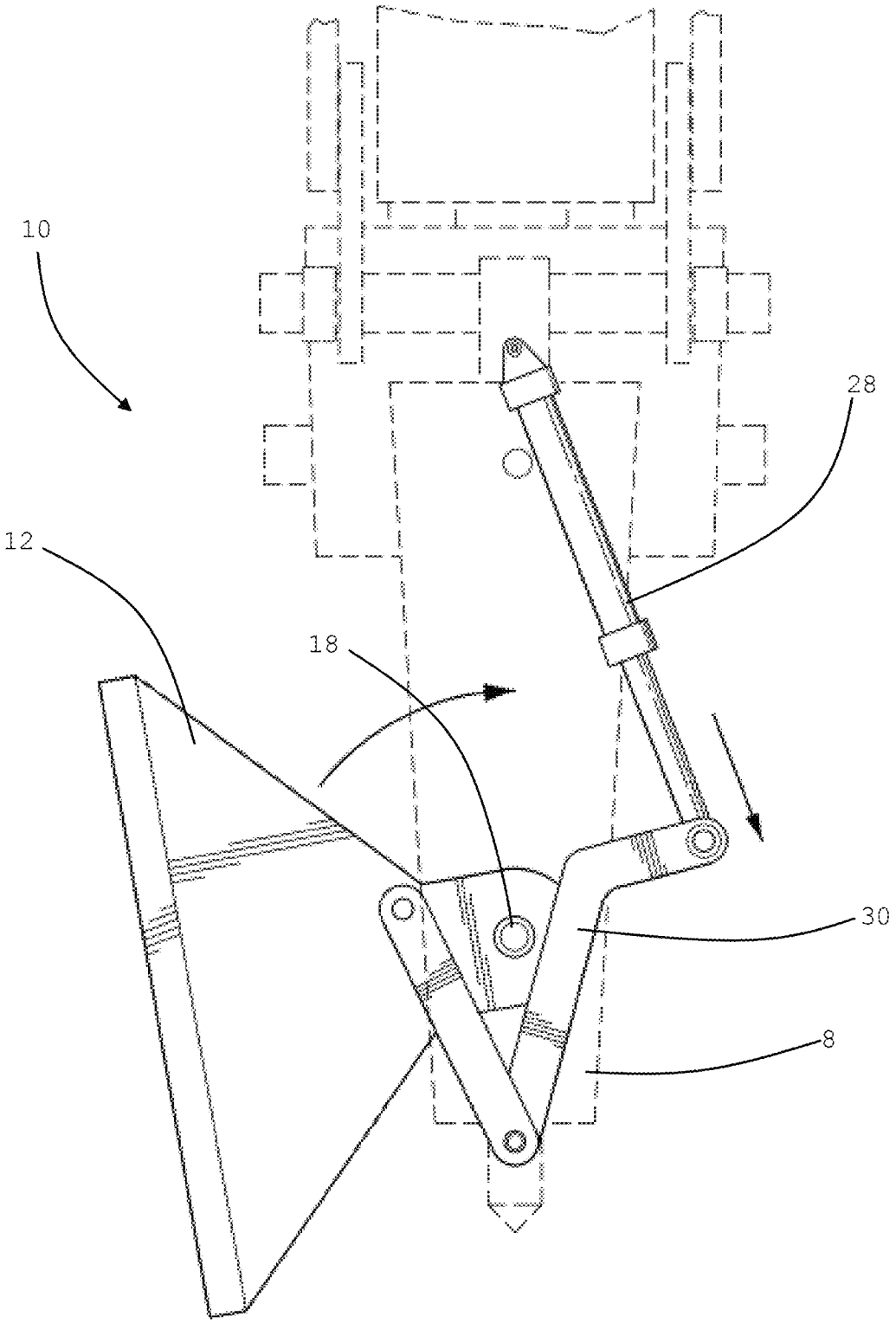
FIG. 4 is a diagrammatic front-view representation of the apparatus of FIG. 2 with the angle adjusted to an acute angle.
Figure 5:
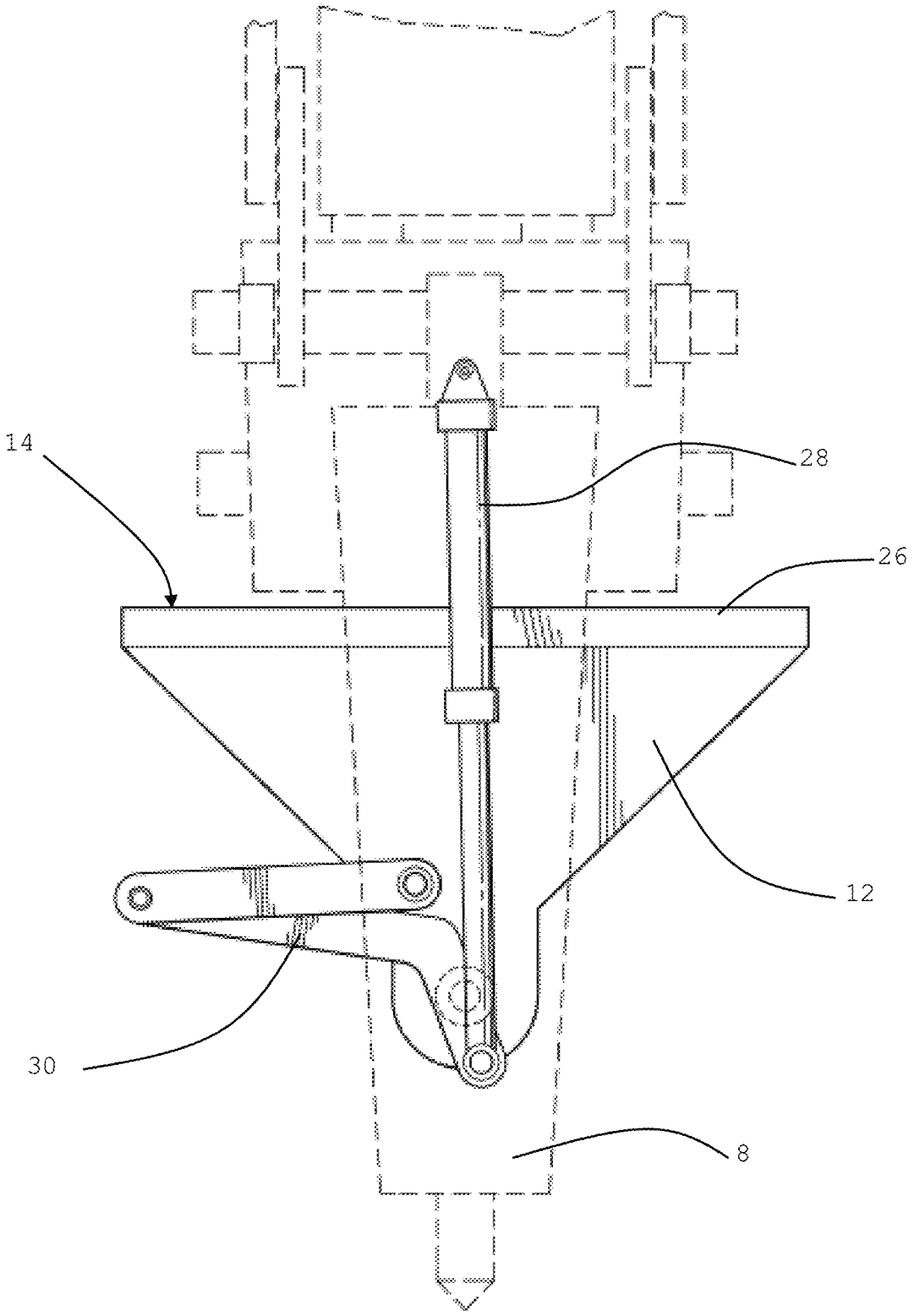
FIG. 5 is a diagrammatic front-view representation of the apparatus of FIG. 2 with the angle adjusted to be perpendicular.
Figure 6:
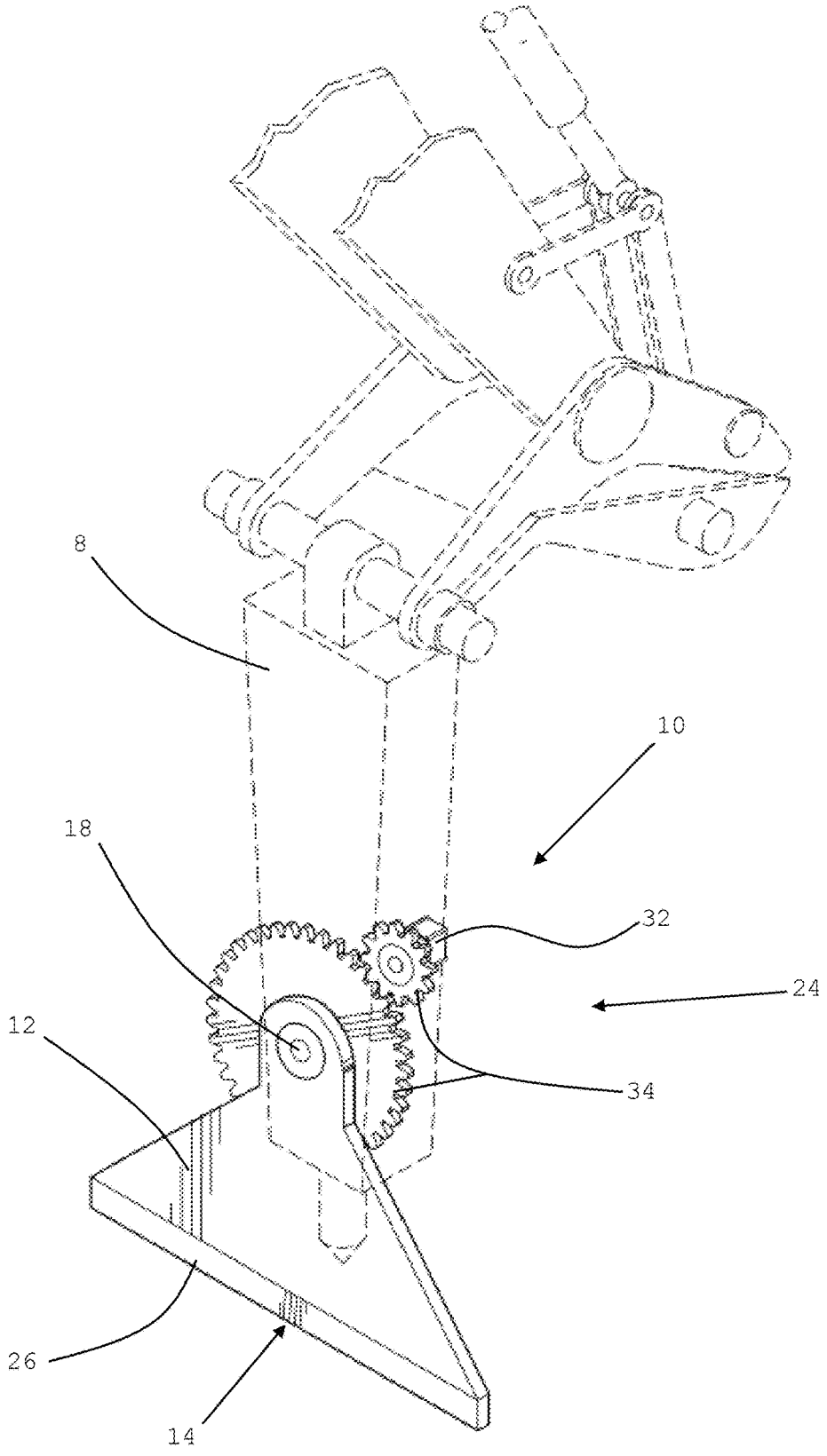
FIG. 6 is a diagrammatic perspective-view representation of a further embodiment of manipulation apparatus for a rockbreaker, in accordance with an aspect of the disclosure.
Figure 7:
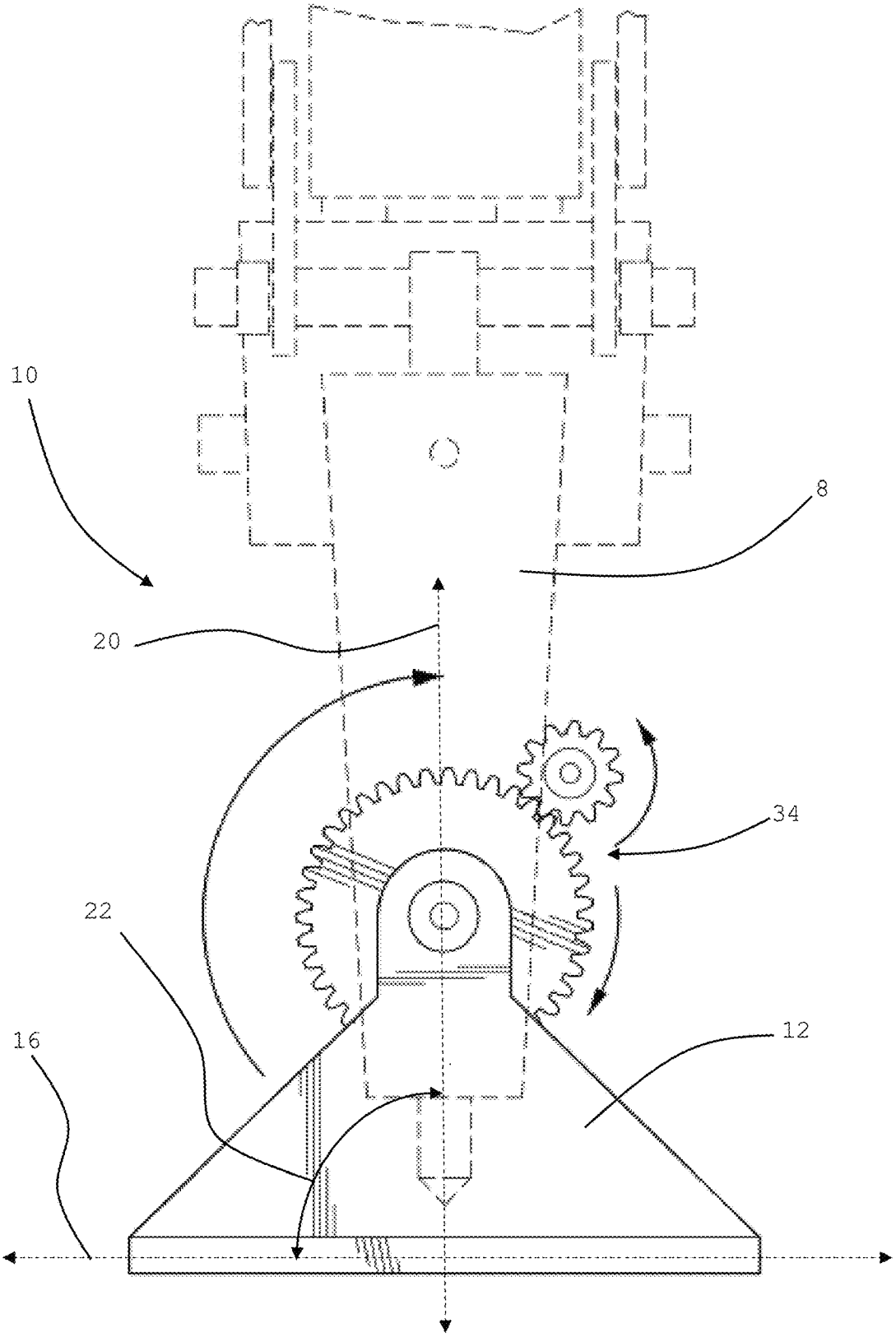
FIG. 7 is a diagrammatic front-view representation of the apparatus of FIG. 6 with an angle formed between an axis along the flat surface and an impact axis of the rockbreaker substantially perpendicular.
Figure 8:
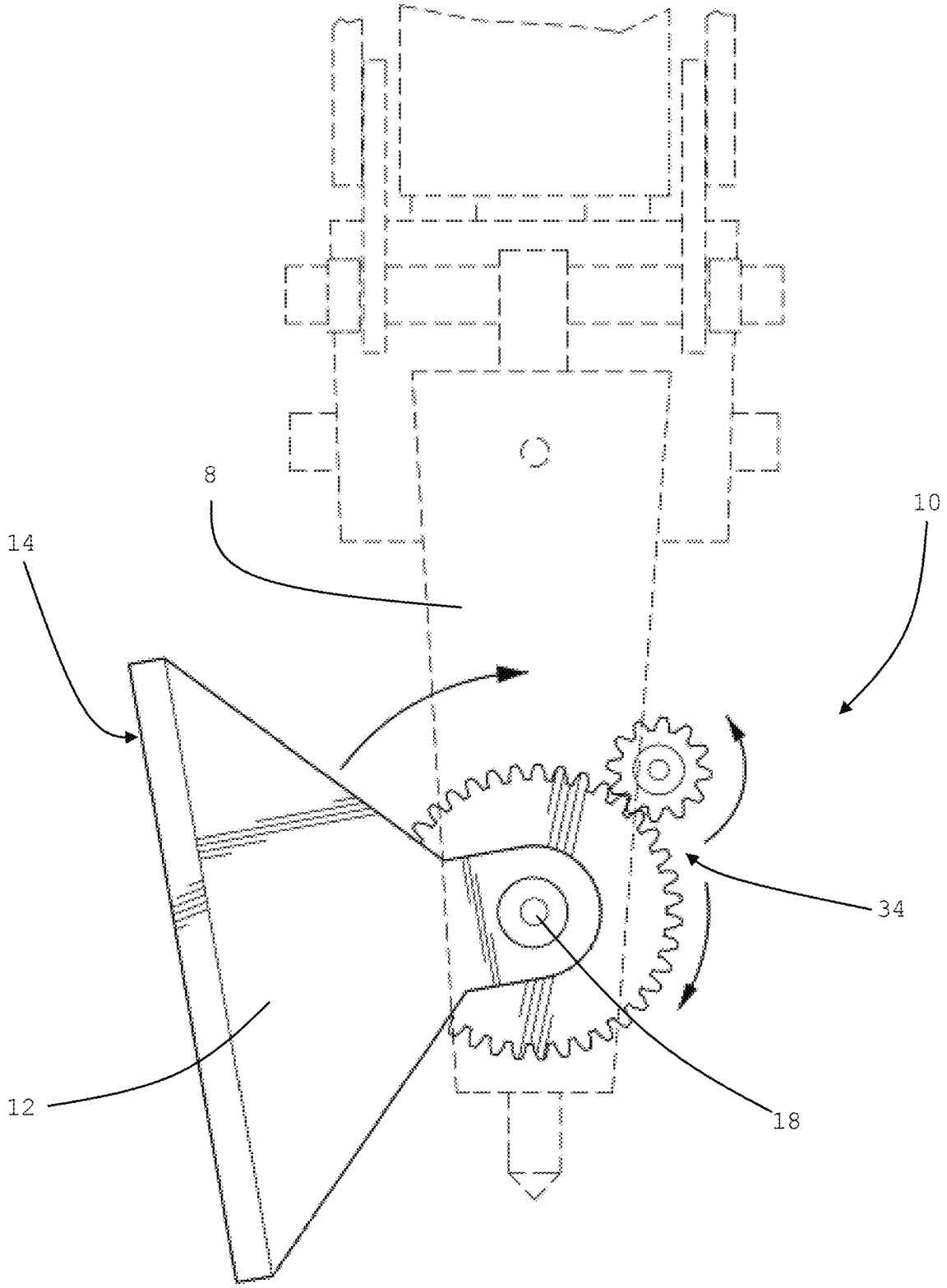
FIG. 8 is a diagrammatic front-view representation of the apparatus of FIG. 6 with the angle adjusted to an acute angle.
Figure 9:
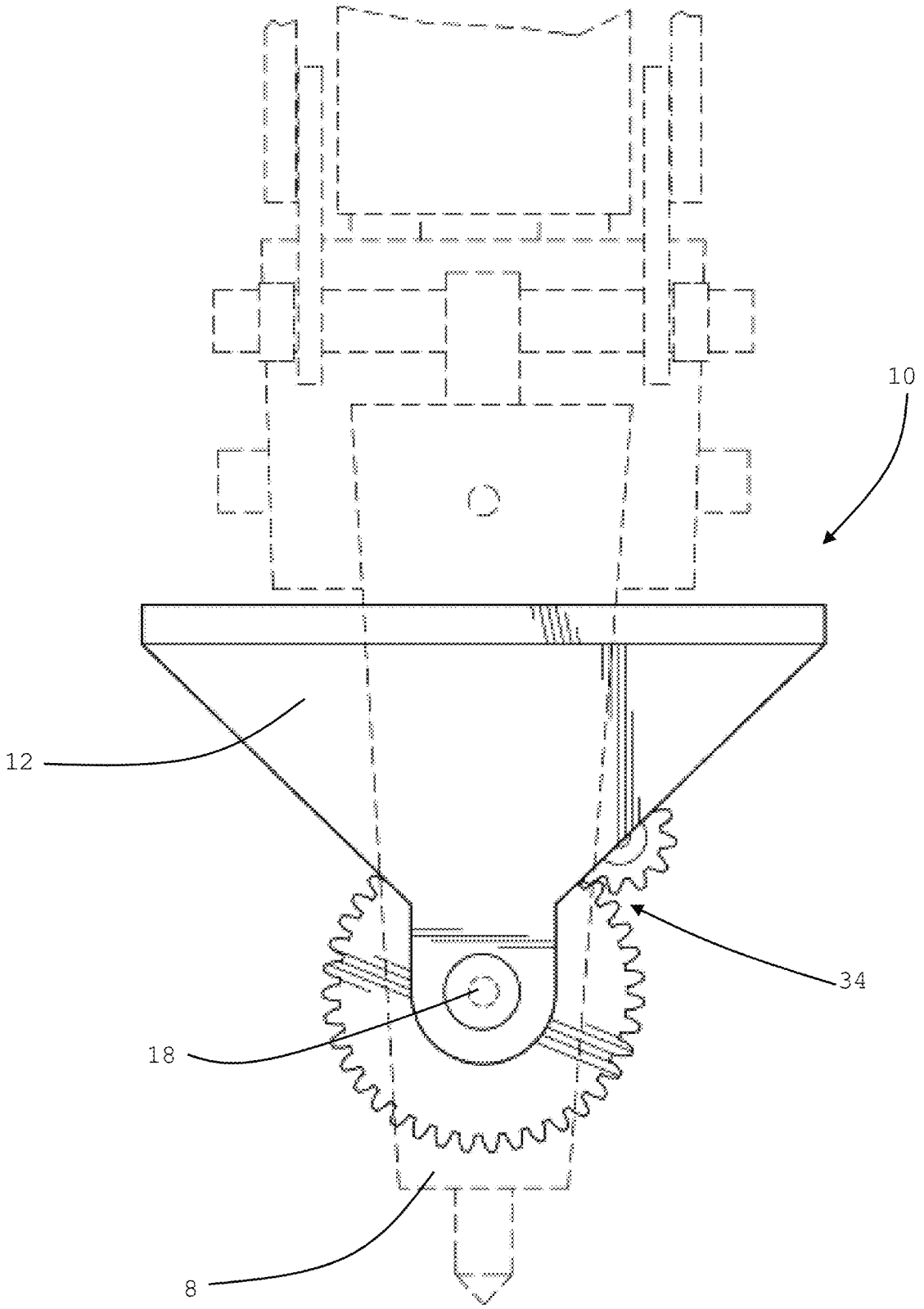
FIG. 9 is a diagrammatic front-view representation of the apparatus of FIG. 6 with the angle adjusted to be perpendicular.

Further features of the present disclosure are more fully described in the following description of several non-limiting embodiments thereof. This description is included solely for the purposes of exemplifying the present disclosure to the skilled addressee. It should not be understood as a restriction on the broad summary, disclosure or description of the disclosure as set out above. In the figures, incorporated to illustrate features of the example embodiment or embodiments, like reference numerals are used to identify like parts throughout.

FIG. 1 shows a prior art example of an excavator platform having a rockbreaker attachment mounted on the boom or arm of the excavator and which is able to fold down for rock breaking or to act as a gripper device. Such an excavator-mounted rockbreaker is common in the art and the disclosure will be described with reference to a similar excavator platform. However, the skilled addressee is to appreciate that the disclosure may be applied to other rockbreaker platforms as well.

Referring now to FIGS. 2 to 9, there is shown examples of different embodiments of manipulation apparatus 10 for a rockbreaker 8, in accordance with aspects of the disclosure. The apparatus 10 generally comprises a manipulation tool 12 which defines at least one substantially flat surface 14, as shown.

In the exemplified embodiment, the manipulation tool 12 comprises a flat blade-like body having a roughly triangular shape, but other shapes are possible and within the scope of the disclosure. In a typical embodiment, the at least one substantially flat surface 14 of the tool 12 comprises a ground-engaging surface 26 on a side of the body, as shown. This ground-engaging surface 26 may include a replaceable cutting edge, teeth, a slightly curved surface, and/or the like, as is known in the art of ground engaging tools.

Apparatus 10 further includes a mounting 18 which is configured to swivelably mount the manipulation tool 12 on the rockbreaker 8 such that an angle 22 formed between an axis 16 along the flat surface 14 and an impact axis 20 of the rockbreaker 8 is infinitely adjustable. In a typical embodiment, the mounting 18 comprises a swivel pin about which the flat surface 14 is able to orbit, as shown, but other mountings are possible and within the scope of the disclosure.

In one embodiment, the mounting 18 mounts the tool 12 on an inside face of the rockbreaker 8 in order to facilitate visibility of the tool 12 by an operator of the rockbreaker 8. However, in other embodiments, the tool 12 may be mounted on other sides or faces of the rockbreaker 8, depending on operator requirements. For example, the rockbreaker 8 may be rotatable about the impact axis 20, which allows precise control of the tool 12 relative to material manipulated thereby.

Apparatus 10 further includes an actuator arrangement 24 which is configured to swivel the tool 12 so that the flat surface 14 is selectively and infinitely adjustable relative to the impact axis 20 to facilitate manipulation of material by the tool 12.

Figure 10:
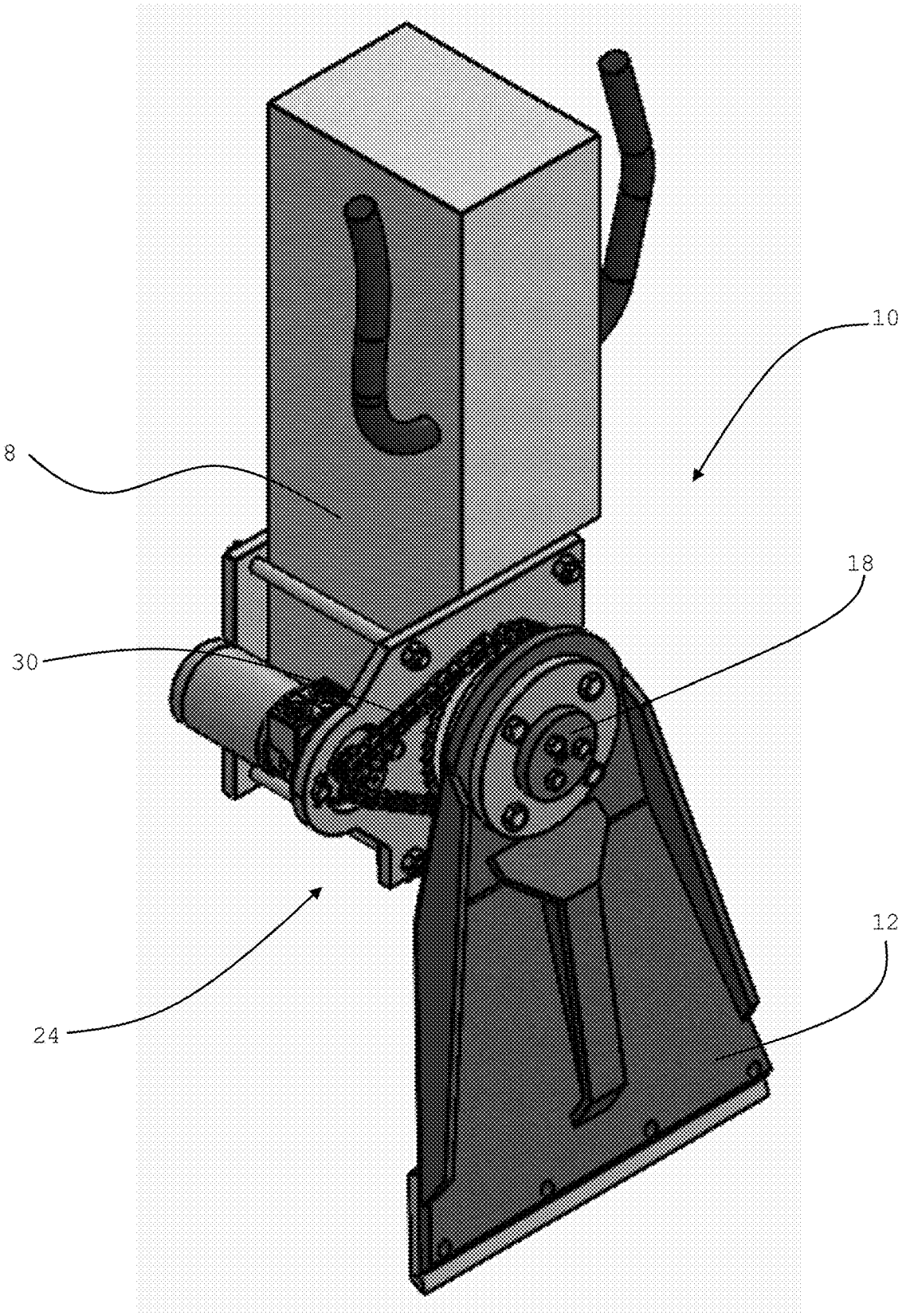
FIG. 10 is diagrammatic perspective-view representation of a further embodiment of manipulation apparatus for a rockbreaker, in accordance with an aspect of the disclosure.

In an embodiment, as shown in FIGS. 2 to 5, the actuator arrangement 24 comprises a hydraulic ram 28 with a suitable linkage 30 to the tool 12 such that translation of the hydraulic ram 28 is converted into rotation of the tool 12 about the mounting 18. In another embodiment, as shown in FIGS. 6 to 9, the actuator arrangement 24 comprises an electric or hydraulic motor 32 with suitable gearing 34 to swivel the tool 12 on the mounting 18. In the embodiment of FIG. 10, the actuator arrangement 24 comprises an electric or hydraulic motor 32 with suitable linkage 30 in the form of a chain drive to swivel the tool 12 on the mounting 18. Again, variations on the actuator arrangement 24 are possible and within the scope of the present disclosure.

For example, in one embodiment, the actuator arrangement 24 comprises a helical hydraulic rotary actuator, such as an actuator from manufacturer Helac™ offered as a powered hydraulic hinge. The skilled addressee is to appreciate that the mounting 18 and actuator arrangement 24 may be comprised as a single unit or as unitary construction via a suitable actuator arrangement 24. For example, the manipulation tool 12 may be mounted on the rockbreaker by means of such a helical hydraulic rotary actuator directly, or by two such actuator mounted substantially orthogonally to each other, or the like.

In this manner, the flat surface 14 of the tool 12 is orbitable about the mounting 18 so that the respective axes 16 and 20 are arrangeable at any angle, such as in parallel or transverse, according to requirements, to facilitate manipulation of material by the tool 12. For example, the tool 12 is swivelable to allow material manipulation while allowing an operator to see the tip or chisel of the rockbreaker 8, or the tool 12 can be swiveled so that the flat surface axis 16 is substantially parallel with the impact axis 20 to allow material to be handled without interfering with operation of the rockbreaker 8, or the like. Tool 12 can also be swiveled out of the way of the tool 12 entirely, i.e., axes 16 and 20 perpendicular with the tool 12 at the top, or such that the tool acts as a scraper or cutting blade with axes 16 and 20 perpendicular with the tool 12 at the bottom, or the like.

The skilled addressee is to appreciate that the present disclosure further includes a rockbreaker 8 having the manipulation apparatus 10 fitted or mounted thereto, as well as an associated method of rock breaking. Such a method generally comprises the steps of providing a rockbreaker 8 having the manipulation apparatus 10 as described herein, breaking material, such as rocks, with the rockbreaker 8, and adjusting, via the actuator arrangement 24, as desired the tool 12 relative to the rockbreaker 8 to facilitate manipulation of material. Typically, the step of adjusting the tool 12 is performed remotely from an operating cabin of the rockbreaker platform, or the like.

Applicant believes it particularly advantageous that the present disclosure provides for apparatus 10 which facilitates material manipulation via a rockbreaker 8 and allows more precise control than prior art rockbreaker blades, which in turn, improves rockbreaker efficiency.

Optional embodiments of the present disclosure may also be said to broadly consist in the parts, elements and features referred to or indicated herein, individually or collectively, in any or all combinations of two or more of the parts, elements or features, and wherein specific integers are mentioned herein which have known equivalents in the art to which the disclosure relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a," "an," "said," "the," and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It is to be appreciated that reference to "one example" or "an example" of the disclosure, or similar exemplary language (e.g., "such as") herein, is not made in an exclusive sense. Various substantially and specifically practical and useful exemplary embodiments of the claimed subject matter are described herein, textually and/or graphically, for carrying out the claimed subject matter.

Accordingly, one example may exemplify certain aspects of the disclosure, while other aspects are exemplified in a different example. These examples are intended to assist the skilled person in performing the disclosure and are not intended to limit the overall scope of the disclosure in any way unless the context clearly indicates otherwise. Variations (e.g., alterations, modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A manipulation apparatus for a rockbreaker, the manipulation apparatus comprising: a manipulation tool comprising a flat, blade-like body defining at least one substantially flat surface, the at least one substantially flat surface of the tool comprising a ground engaging surface on a side of the flat blade-like body; a mounting configured to swivelably mount the manipulation tool on the rockbreaker such that an angle formed between an axis along the flat surface and an impact axis of the rockbreaker is infinitely adjustable, the axis along the flat surface being defined as a line of action along which the ground engaging surface contacts material during manipulation; and an actuator arrangement configured to swivel the manipulation tool so that the flat surface is selectively and infinitely adjustable relative to the impact axis to facilitate manipulation of material by the manipulation tool.

2. The manipulation apparatus of claim 1, wherein the flat blade-like body defines a triangular shape.

3. The manipulation apparatus of claim 1 wherein the ground engaging surface includes a replaceable cutting edge.

4. The manipulation apparatus of claim 1, wherein the mounting comprises a swivel pin about which the flat surface is able to orbit.

5. The manipulation apparatus of claim 1, wherein the flat surface of the tool is orbitable about the mounting so that the respective axes are arrangeable in parallel or transverse.

6. The manipulation apparatus of claim 1, wherein the mounting mounts the tool on an inside face of the rockbreaker to facilitate visibility of the tool by an operator.

7. The manipulation apparatus of claim 1, wherein the actuator arrangement comprises a hydraulic ram with a linkage to the tool such that translation of the ram is converted into rotation of the tool about the mounting.

8. The manipulation apparatus of claim 1, wherein the actuator arrangement comprises an electric or hydraulic motor with gearing and/or linkage to swivel the tool on the mount, and/or a helical hydraulic rotary actuator.

9. A rockbreaker having a manipulation apparatus comprising: a manipulation tool comprising a flat, blade-like body defining at least one substantially flat surface, the at least one substantially flat surface of the tool comprising a ground engaging surface on a side of the flat blade-like body; a mounting swivelably mounting the manipulation tool on the rockbreaker such that an angle formed between an axis along the flat surface and an impact axis of the rockbreaker is infinitely adjustable, the axis along the flat surface being defined as a line of action along which the ground engaging surface contacts material during manipulation; and an actuator arrangement configured to swivel the tool so that the flat surface is selectively and infinitely adjustable relative to the impact axis to facilitate manipulation of material by the tool.

10. The rockbreaker of claim 9, wherein the flat blade-like body defines a triangular shape.

11. The rockbreaker of claim 9, wherein the mounting comprises a swivel pin about which the flat surface is able to orbit.

12. The rockbreaker of claim 9, wherein the flat surface of the tool is orbitable about the mounting so that the respective axes are arrangeable in parallel or transverse.

13. The rockbreaker of claim 9, wherein the actuator arrangement comprises a hydraulic ram with a linkage to the tool such that translation of the ram is converted into rotation of the tool about the mounting.

14. The rockbreaker of claim 9, wherein the actuator arrangement comprises an electric or hydraulic motor with gearing and/or linkage to swivel the tool on the mount, and/or a helical hydraulic rotary actuator.

15. A method of rock breaking, comprising:

providing a rockbreaker having the manipulation apparatus of claim 1;

breaking material with the rockbreaker; and adjusting, via the actuator arrangement, the manipulation tool relative to the rockbreaker to facilitate manipulation of the material.

16. The method of claim 15, wherein adjusting the manipulation tool is performed remotely from an operating cabin of the rockbreaker.

* * * * *